US012799931B2

(12) United States Patent
Quintero Gamez et al.

(10) Patent No.: US 12,799,931 B2
(45) Date of Patent: Nov. 17, 2026

(54) MICROFLUIDIC FLOW RATE CONTROL DEVICE AND METHOD

(71) Applicant: MICRO ELECTROCHEMICAL TECHNOLOGIES S.L., Móstoles (ES)

(72) Inventors: Alberto Emanuel Quintero Gamez, Móstoles (ES); Alberto Bernaldo De Quirós Sanz, Móstoles (ES); Beatriz Oraá Poblete, Móstoles (ES)

(73) Assignee: MICRO ELECTROCHEMICAL TECHNOLOGIES S.L., Móstoles (ES)

( * ) Notice: Subject to any disclaimer, the term of this patent is extended or adjusted under 35 U.S.C. 154(b) by 0 days.

(21) Appl. No.: 18/251,948

(22) PCT Filed: Nov. 15, 2021

(86) PCT No.: PCT/EP2021/081702
§ 371 (c)(1),
(2) Date: May 5, 2023

(87) PCT Pub. No.: WO2022/101477
PCT Pub. Date: May 19, 2022

(65) Prior Publication Data

US 2024/0003342 A1 Jan. 4, 2024

(30) Foreign Application Priority Data

Nov. 13, 2020 (EP) ..... 20382985

(51) Int. Cl.
*F04B 43/04* (2006.01)
*F04B 7/02* (2006.01)
(Continued)

(52) U.S. Cl.
CPC ..... *F04B 43/046* (2013.01); *F04B 7/02* (2013.01); *F04B 13/00* (2013.01); *F04B 19/006* (2013.01); *F04B 23/04* (2013.01); *F04B 49/06* (2013.01)

(58) Field of Classification Search
CPC ..... F04B 43/046; F04B 49/06; F04B 7/02; F04B 13/00; F04B 19/006; F04B 23/04
See application file for complete search history.

(56) References Cited

U.S. PATENT DOCUMENTS 4,874,016 A * 10/1989 Tseng ..... F15C 4/00 137/833
6,158,269 A * 12/2000 Dorenkott ..... G01N 1/38 422/562
(Continued)

FOREIGN PATENT DOCUMENTS

AU 2016222324 A1 9/2016
CN 1662269 A 8/2005
(Continued)

OTHER PUBLICATIONS

International Search Report for International Application No. PCT/EP2021/081702, dated Jan. 21, 2022, 3 pages.
(Continued)

*Primary Examiner* — Connor J Tremarche
(74) *Attorney, Agent, or Firm* — Snell & Wilmer LLP

(57) ABSTRACT

A microfluidic flow rate control device for controlling a flow rate of a fluid flowing through a microfluidic conduit includes an inlet terminal for fluid input and an outlet terminal for fluid output, and a microfluidic conduit communicating the inlet terminal with the outlet terminal. The control device also includes; pumps for pumping the fluid through the conduit at a particular flow rate, valves for adjusting the flow rate of the fluid modifying their passageways, and a flow sensor for measuring the flow rate within
(Continued)

the conduit and a controller for receiving the measured flow rate, comparing it with a predefined flow rate and instructing the pumps and/or the valves to modify their pumping powers and passageways of the valves, respectively, based on the result of the comparison. The microfluidic conduit, the pumps, the flow sensor and the valves may be arranged inside the protective housing.

17 Claims, 8 Drawing Sheets

(51) Int. Cl.

| | |
|---|---|
| ***F04B 13/00*** | (2006.01) |
| ***F04B 19/00*** | (2006.01) |
| ***F04B 23/04*** | (2006.01) |
| ***F04B 49/06*** | (2006.01) |

(56) References Cited

U.S. PATENT DOCUMENTS

2005/0225201 A1* 10/2005 Vogeley ..... H10N 30/802 310/317
2007/0278319 A1* 12/2007 Jenkins ..... F24C 3/128 126/273 R
2008/0101971 A1 5/2008 Mayer
2012/0051946 A1* 3/2012 Lee ..... F04B 43/046 417/413.2
2013/0209278 A1* 8/2013 Locke ..... F04B 43/046 417/313
2015/0219089 A1* 8/2015 Glauber ..... F04B 43/0733 417/472
2017/0159650 A1* 6/2017 Richter ..... F16K 99/0001
2020/0040458 A1* 2/2020 Ma ..... C23C 16/45502

FOREIGN PATENT DOCUMENTS

| | | | |
|---|---|---|---|
| JP | 2007532285 | A | 11/2007 |
| JP | 2007333752 | A | 12/2007 |
| JP | 2012047172 | A | 3/2012 |
| NO | 2007082480 | A1 | 7/2007 |
| WO | 2004000394 | A1 | 12/2003 |
| WO | 2007082480 | A1 | 7/2007 |
| WO | 2013116285 | A1 | 8/2013 |

OTHER PUBLICATIONS

Written Opinion for International Application No. PCT/EP2021/081702, dated Jan. 21, 2022, 6 pages.

* cited by examiner

MICROFLUIDIC FLOW RATE CONTROL DEVICE AND METHOD

CROSS-REFERENCE TO RELATED APPLICATIONS

This application is a 35 U.S.C. § 371 National Stage patent application of PCT/EP2021/081702, filed on 15 Nov. 2021, which claims the benefit of European patent application 20382985.8, filed on 13 Nov. 2020, the disclosures of which are incorporated herein by reference in their entirety.

TECHNICAL FIELD

In general, the present disclosure relates to microfluidic flow control systems which are used to provide a controlled dose or flow of a fluid. More particularly, the present disclosure refers to a microfluidic flow rate control device that includes high precision flow regulation means and that is able to dispense fluids, including liquids and gases, in a controlled manner, in both, open-circuit regimes and closed-circuit regimes and to a method for controlling a flow rate of a fluid flowing through a microfluidic conduit that makes use of the microfluidic flow rate control device. The present disclosure falls within the sectors of control and dispensing of microfluids.

BACKGROUND

Dosing a substance consists of providing, in a controlled manner, previously defined and measured quantities of the substance for a given user, process, apparatus or system. The dosage can be of liquid, solid or gaseous materials. In any of these cases, the dosing process can be carried out in a manual or automatic manner. Dosing devices or systems are used in a wide range of applications and technical fields such as medicine, engineering or research, among others. Early versions of these dosing devices or systems had large and complex designs, were difficult to calibrate and clean, and were unreliable since the dosages provided had significant deviations from the expected values due to inaccuracies of the measurement and dosing technologies they integrated. Recent developments made in the dosing devices have improved their calibration and their size has also been reduced, allowing these devices to be smaller and more compact. However, these dosing devices still present a low precision and accuracy rates for controlling fluid flows. This is especially problematic in some applications and sectors, e.g. in medicine, where accuracy and precision are key factors.

Devices widely used for dosing liquids and gases are fluid pumps, also known as impulsion/suction systems, which can be generally classified as positive displacement pumps, rotary pumps or dynamic pumps. The medical sector and the industry have driven the development of such pumps, highlighting the peristaltic and syringe pumps. One of the main problems these pumps must face is how to guarantee that they are able to provide a constant fluid flow rate during their entire operational life. On one hand, peristaltic pumps present the drawback that as they age, they suffer a significant wear in some of their main components which results in a reduction in the precision of the flow being pumped. In addition, the accuracy range of peristaltic pumps is low, making them unsuitable for uses that require very small and precise flows. On the other hand, syringe pumps have certain limitations, as they cannot operate continuously due to their particular configuration and their design is bulky making them unsuitable for compact and portable equipment. There exist other types of fluid pumps such as the pneumatic fluid dispensers, that use gas to generate pressure on the fluid reservoirs while flow regulation is performed by means of microvalves controlling the pressure applied to the reservoirs at the inlet of the system. However, the management of the pneumatic fluid dispensers is quite complex and their design quite bulky which makes them unsuitable for portable equipment and applications. The pneumatic fluid dispensers are also unsuitable for being used in closed fluid circuits since they are not able to return the fluid being pumped back to the initial pressurized tank.

Due to the need to miniaturize the flow control systems and improve their accuracy, precision and efficiency, technologies such as microfluidics and microelectromechanical systems (MEMS) have contributed to the development of new devices and concepts, such as piezoelectric micropumps and piezoelectric microvalves. Piezoelectric effect is the ability of certain materials to generate an electric charge in response to applied mechanical stress. One of the unique characteristics of the piezoelectric effect is that it is reversible, meaning that materials exhibiting the direct piezoelectric effect (the generation of electricity when stress is applied) also exhibit the converse piezoelectric effect (the generation of stress when an electric field is applied). Piezoelectric micropumps are based on the converse piezoelectric effect. They comprise a piezoelectric diaphragm in combination with passive check valves and a membrane, which deforms when a voltage is applied. The piezoelectric pump has a simple structure, a slim shape and low power consumption.

Besides, valves are devices commonly used in these dosing devices, systems and processes. Valves are mechanisms that regulate the flow flowing between two parts of the system, allowing the selective passage or blocking of a flow (liquids or gases) in pipes, conducts or similar. These valves, at micro level, can be active valves or passive valves. The active microvalves comprise a mechanically movable membrane or protruding structure, coupled to an actuator. This membrane or protruding structure can close a passing orifice, thus blocking the flow path between the inlet and outlet ports of the valve. The actuator of the microvalves can be an integrated magnetic, electrostatic, piezoelectric or thermal micro-actuator, an "intelligent" phase change, a rheological material, or an externally applied drive mechanism such as an external magnetic field or pneumatic source. On the other hand, passive microvalves are valves for which their operating state, i.e., whether they are open or closed, is determined by the fluid they control, so that, in this case, the actuator would be the pressure or other physical characteristics of the fluid itself. The most common passive microvalves are flap valves, membrane microvalves and ball microvalves.

Most of the well-known fluid control devices and systems are still not able to solve the problem of precision and accuracy over the fluid flow being provided, being those that are more precise and accurate unable to operate continuously in a closed fluidic circuit with constant recirculation of the fluid between the reservoir and the microfluidic system, and even those are not compact in size to fully integrate them directly in microfluidic devices, most of them are not able to bring together the principles of modularity, reliability, low costs, and easy operation.

Therefore, there is still the need in the state of the art for microfluidic flow rate control devices which are capable of overcoming the above cited technical problems, presenting compact designs, which are easy to operate, that are able to work with a wide variety of fluids, that combine miniaturization with high precision in both open and closed fluid circuits, as well as they present low energy consumption and low cost.

SUMMARY

The disclosure presents a flow rate control device that incorporates high precision regulation means, capable of dispensing fluids in a controlled manner in both, open-circuit and closed-circuit regimes. The device will have a modular design that facilitates its integration in stationary or portable equipment, and will have application in a wide variety of sectors such as life sciences sector, automotive industry, medical sector or fluid dispensing and dosing in general, among others.

The disclosure provides a microfluidic flow rate control device for controlling a flow rate of a fluid flowing through a microfluidic conduit. As used herein, the term "microfluidic" may refer to the behaviour, precise control, and manipulation of fluids that are geometrically constrained to a small scale (typically sub-millimeter) at which surface forces dominate volumetric forces. As used herein, the term "microfluidic conduit" may refer to conduits, pipes, ducts, tubes, channels, etc., whose dimensions, mainly its cross-section, is in the range of micrometres or lower. The microfluidic flow rate control device comprises an inlet terminal for fluid input and an outlet terminal for fluid output, a microfluidic conduit that is fluidly communicating the inlet terminal with the outlet terminal and at least one pump arranged in the microfluidic conduit for pumping the fluid through the microfluidic conduit at a particular flow rate. Preferably, the pumps will be micropumps. As used herein, micropumps may refer to pumps with functional dimensions in the micrometre range. The pumps will be generally located at the inlet terminal in order to pump the fluid entering in the control device through its inlet terminal. As used herein, the term "fluid" may indistinctly refer to any kind of fluid, gas or any combination thereof.

The microfluidic flow rate control device further comprises at least one valve arranged in the microfluidic conduit. The valves may be microvalves, i.e., valves in the micrometre range. For example, the valves may be Quake valves or Shape Memory Alloy (SMA) valves, among others. The at least one valve may be located at the outlet terminal or in any other part of the microfluidic conduit. The valves are configured to adjust or modify their passageway, by changing the hydraulic diameter of their cross-section, to change the flow rate of the fluid that is passing through the microfluidic conduit. The microfluidic flow rate control device also comprises a flow sensor arranged in the microfluidic conduit. Although the flow sensor, for example a flowmeter, may be preferably located between the pumps and the valves, said flow sensor may be located in any other part of the microfluidic conduit. The flow sensor is configured to measure the flow rate within the microfluidic conduit at the particular point in which it is installed.

The microfluidic flow rate control device further comprises a controller that is configured to receive the flow rate measured by the flow sensor, compare the measured flow rate with a predefined flow rate and instruct at least one of the at least one pump and the at least one valve to modify their pumping powers and passageways, respectively, based on the result of the comparison. The controller will instruct the pumps and/or the valves to modify their respective pumping powers and passageways in order to minimize the difference between the measured flow rate and the predefined flow rate. The predefined flow rate is a flow rate previously determined by a user that may vary depending on the particular requirements of the system or application in which the microfluidic flow rate control device is installed or used. A threshold for the difference between the measured flow rate and the predefined flow rate could be also established such that only when the difference obtained is over said threshold, the controller instructs the pumps and/or the valves to modify their pumping power and/or passageways.

The controller may execute pump control actions comprising instructing the pumps to increase or decrease the fluid pressure by increasing or decreasing their pumping power, i.e., the amount of impulsion energy provided to the fluid that flows through the microfluidic conduit. Therefore, these pump control actions include a pumping power value, that is different from the current pumping power value, to be delivered by the pumps, said new pumping power value being within the operational range of the pumps. Alternatively, the controller may execute valve control actions comprising instructing the valves to increase or decrease the resistance to flow by modifying their passageways, i.e., the resistance to the passage of the fluid the valves offer by changing the hydraulic diameter of their cross-section. Said valve control actions include a passageway value, that is different from the current passageway value, so that the valves can adjust their passageway to this new value. This new passageway value will be within the operational range of the valves. The controller may further simultaneously execute the mentioned pump and valve control actions based on the result of the comparison.

In some embodiments, the microfluidic flow rate control device comprises a main body at least partially housing the microfluidic conduit. The at least one pump, the flow sensor, the controller and the at least one valve may be fixed to or be an integral part of the main body. In some other embodiments, the at least one pump, the flow sensor, the controller and the at least one valve may be removably coupled to the main body to facilitate their replacement if they fail. For example, the at least one pump, the flow sensor and the at least one valve may be fluidly connected to the main body by interposition of interconnection pipes which are also part of the microfluidic conduit.

In some embodiments, the microfluidic flow rate control device may be arranged inside the protective housing providing a compact and small design especially useful for applications which demand such small and compact devices. The protective housing may be made of plastic or metallic material, among other materials, and may be configured to provide enough structural rigidity to house and protect all the components of the microfluidic flow rate control device.

In some embodiments, the microfluidic flow rate control device comprises a plurality of valves connected in series to each other along a portion of the microfluidic conduit. These valves may similarly or differently modify their respective passageways to jointly adjust the fluid flow passing through them. Preferably, the microfluidic flow rate control device will have two or three valves connected in series. Said plurality of valves connected in series allows having a better control over the fluid flow. All the valves of the plurality of valves may be the same type of valve or may be different.

In some embodiments, the valves are pneumatic valves and the microfluidic flow rate control device comprises a respective pneumatic pump or compressor fluidly connected to each one of the pneumatic valves. These pneumatic pumps use air to actuate the valves so they open or close to adjust their passageways. These pneumatic valves have a higher stability, resolution, and accuracy than other valves, which provides a better control over the fluid flowing through them.

In some embodiments, the microfluidic flow rate control device comprises a plurality of micropumps connected in series for pumping the fluid through the microfluidic conduit at the particular flow rate. Having a plurality of micropumps connected in series allows having a better control over the flow rate with which the fluid is being pumped. Besides, it allows reaching high pump rates with a set of low-power pumps, which are generally cheaper and smaller, connected in series.

In some embodiments, the at least one valve is arranged in the microfluidic conduit between the flow sensor and the outlet terminal. In such embodiments, the flow sensor is located at the outlet of the pump so that the flow rate is measured prior to being adjusted by the valves. In this way, the controller can execute valve control actions to adjust the passageway of the valves so that adjusted flow rate is as close as possible to the predefined flow rate, immediately prior to the fluid leaving the control device via its outlet terminal.

In some embodiments, the controller is wired to the sensors, pumps and valves. Alternatively, the controller is a remote controller external to the microfluidic flow rate control device and the control device may incorporate a wireless connection unit wired to the sensors, pumps and valves that bidirectionally communicates by, for example, GPRS, WiFi, Bluetooth, etc., with the remote controller.

In some embodiments, the pumps are piezoelectric micropumps and the valves are piezoelectric microvalves. Piezoelectric microvalves incorporate more robust and simple actuators than other kinds of valves. These piezoelectric components contribute to extend the operational life of the control device.

In some embodiments, the microfluidic conduit comprises a fixed flow resistance device that is configured to introduce a fixed pressure drop in the fluid flow flowing through the microfluidic conduit. As used herein, a fixed flow resistance device is any device arranged to the microfluidic conduit that is able to introduce a fixed pressure drop in the fluid when it passes therethrough. Examples of flow resistance devices may be serpentine circuits, portions of conduit with a cross-section different from the cross section of the microfluidic conduit, a porous element such as a filter, etc. Therefore, this flow resistance device, that is especially useful when the fluid flowing through the microfluidic conduit presents low viscosity (e.g., water), introduces a known and constant pressure drop to reduce the fluid pressure flowing through the microfluidic conduit when the pumps pump the fluid at a too high working range. This fixed flow resistance device may be preferably located between the pumps and the flow sensor, although it may be located in any other part of the microfluidic conduit.

In some embodiments, the microfluidic flow rate control device comprises a pressure sensor arranged in the microfluidic conduit, the pressure sensor being configured to measure a pressure of the fluid flowing through the microfluidic conduit.

In some embodiments, the microfluidic flow rate control device comprises a temperature sensor arranged in the microfluidic conduit, the temperature sensor being configured to measure a temperature of the fluid flowing through the microfluidic conduit. The microfluidic flow rate control device may further comprise other measuring devices such as viscometers, densimeters, etc., to monitor other parameters of the fluid.

In some embodiments, the microfluidic flow rate control device comprises a graphical user interface communicatively coupled to at least one of the sensors that integrate the control device. The graphical user interface is configured to display the flow rate, pressure, temperature or any other parameter of the fluid flowing through the microfluidic conduit measured by the at least one sensor. Depending on the sensors that the microfluidic flow rate control device integrates, the graphical user interface will be able to display the corresponding measured parameters. Therefore, the control device may integrate a screen communicatively coupled with the controller and through which the measured parameters are displayed via the graphical user interface.

In some other embodiments, the microfluidic flow rate control device comprises a USB port through which a user with a personal computing device such as a laptop or a tablet, among others, may communicate with the controller of the microfluidic flow rate control device in order to establish a bidirectional communication with the components of the control device. In this way, the user may receive in its personal computing device information from the sensors, pumps, valves and the controller, and at the same time may establish the operating parameters of the control device, e.g., the predefined flow rate, the initial pumping power of the pumps and the initial passageway of the valves, etc.

In some embodiments, the microfluidic flow rate control device comprises a user input device configured to allow a user to select the operating parameters, such as the predefined flow rate value for the fluid flowing through the microfluidic conduit, of the control device. The user may select other parameters such as the initial pumping power of the pumps and initial passageway of the valves, among others. This user input device may be a keypad communicatively coupled to the controller through which the user can select a particular predefined flow rate value or other operating parameters and to a screen through which the user can visualize said predefined flow rate value and operating parameters. Preferably, this screen will be the same screen used for displaying the parameters measured by the sensors. Alternatively, the control device may integrate a wireless connection device that is communicatively coupled to the controller and the user input device may be part of a personal computing device, such as a PDA, laptop, mobile phone, etc. The user may select specific operating parameters of the control device in its personal computing device which would be sent to the wireless connection device via, for example, a GPRS, WiFi, Bluetooth, etc., connection. In some other embodiments, the microfluidic flow rate control device may incorporate a tactile touch screen to interact directly with what is displayed and through which the user can introduce the operating parameters of the control device and visualize the predefined flow rate value and other operating parameters of the control device.

In some embodiments, the microfluidic flow rate control device comprises an electrical energy storage unit connected to the pumps, to the controller, to the sensors and to the valves such that electrical power is provided from the electrical energy storage unit to the pumps, controller, sensors and valves. Alternatively, the microfluidic flow rate control device may comprise a plug to be connected to the electrical network.

In some embodiments, the microfluidic flow rate control device is installed in a closed fluid circuit. In such embodiments, the control device works under the closed-circuit regime of fluids.

In some embodiments, the microfluidic flow rate control device is installed in an open fluid circuit. In such embodiments, the control device works under the open-circuit regime of fluids.

In some embodiments, when the microfluidic flow rate control device is to be used for medical applications, the elements which are in contact with the fluid, i.e., the microfluidic conduit including the interconnection pipes, the inner conduits or ducts of the valves, pump and flow sensor, etc., may be manufactured of or coated with biocompatible materials or particularly inert materials, in order to adapt the control device to the specific requirements of the medical application.

In some embodiments, the outlet terminal of a first microfluidic flow rate control device may be fluidly connected to the inlet terminal of a second microfluidic flow rate control device. There may be as many microfluidic flow rate control devices connected in series as necessary based on the particular design. By connecting these microfluidic flow rate control devices in series, precision and accuracy over the fluid flow at the outlet port of the last microfluidic flow rate control device is significantly improved. In such embodiments, each microfluidic flow rate control device may have its own controller communicatively coupled to the controllers of the rest of microfluidic flow rate control devices. With said plurality of controllers, a master-slave hierarchy can be established between the controllers, such that the master controller receives the measured parameters from the slave controllers and instructs them on how to adjust the pumping powers of the pumps and/or the passageways of the valves. In turn, the slave controllers instruct the respective pumps and/or valves of the respective control devices according to the received instructions. Alternatively, there may be one single controller receiving measures from all sensors and instructing all the pumps and/or valves of the control devices.

As used herein, a "controller" may be at least one of a central processing unit (CPU), a semiconductor-based microprocessor, a programmable PLC, a graphics processing unit (GPU), a field-programmable gate array (FPGA) configured to retrieve and execute instructions, other electronic circuitry suitable for the retrieval and execution instructions stored on a machine-readable storage medium, or a combination thereof. The controller will be fed with the data received from the different sensors throughout the control device and will manage the operation of the pumps and valves.

Preferably, the microfluidic flow rate control device comprises a printed circuit board (PCB) the controller is coupled to, having its corresponding electronic circuitry. The storage medium from which the controller fetch and decode instructions may be located in the PCB too. The PBC will operate as an interface for the electrical connections between the controller and the electronic components of the control device, such as pumps, valves, sensors, display, button panels, and so on. This PCB may be further coupled to the main body of the microfluidic flow rate control device.

The disclosure also provides a method for controlling a flow rate of a fluid flowing through a microfluidic conduit that makes use of the microfluidic flow rate control device previously described. The method comprises:

- pumping, by the at least one pump, the fluid through the microfluidic conduit at a particular flow rate;
- measuring, by the fluid sensor, the flow rate of the fluid within the microfluidic conduit;
- comparing, by the controller, the measured flow rate with a predefined flow rate; and
- instructing, by the controller, at least one of the at least one pump and the at least one valve to modify their pumping power and their passageways, respectively, based on the result of the comparison. For example, if the measured flow rate is higher than the preestablished flow rate, the controller may execute valve control actions to instruct the valve to reduce its passageway so that the flow rate of the fluid in the microfluidic conduit is as close as possible to the preestablished flow rate. On the contrary, if the measured flow rate is lower than the preestablished flow rate, the controller may execute valve control actions to instruct the valve to increase its passageway so that the flow rate of the fluid in the microfluidic conduit is as close as possible to the preestablished flow rate. Alternatively, the controller may execute pump control actions to instruct the pumps to reduce or increase their delivered pumping power to modify the flow rate of the fluid flowing though the microfluidic conduit when the measured flow rate is higher or lower, respectively, than the preestablished flow rate. The controller may further simultaneously execute valve and pump control actions to instruct both, the valves and the pumps, to modify their respective pumping powers and passageway when there is a deviation between the measure flow rate and the preestablished flow rate.

In some embodiments, executing valve control actions comprises instructing the corresponding pneumatic pumps or compressors to adjust the passageway of the pneumatic valves based on the result of the comparison.

In some embodiments, the controller instructs only the pumps to modify the pumping power they are delivering to the fluid flowing through the microfluidic conduit when the difference between the measured flow rate and the predefined flow rate is at a certain value and the pump control action is also at a certain value. For example, the flow rate at the outlet of the pumps would be adjusted only by the pumps when the flow difference is below 200 microlitre per minute and the current pumping power of the pumps is close to the middle of the range (for example between 120 and 180 volts in the case of a piezoelectric pump). Further, the controller instructs only the valves to modify the flow rate of the fluid flowing through the microfluidic conduit when the difference between the measured flow rate and the predefined flow rate is between some predefined values and the pumping power of the pumps is close to one of the limits of its operational range. For example, the flow rate at the outlet of the valves would be adjusted by the valves when the cited difference is between 200 and 100 microlitre per minute and the pumping power is close to its upper limit (e.g., above 200 volts for the case of a piezoelectric pump). Besides, the controller instructs both, the pumps and the valves, to simultaneously adjust their respective pumping powers and the passageways when the difference between the measured flow rate and the predefined flow rate is above some value and both the current pumping power of the pumps and the current passageways of the valves are in their middle values (within their corresponding operational ranges). For example, they will be simultaneously instructed when the cited difference is above 100 microlitre per minute and both the pumps and the valves are currently working close to the middle point of their operational ranges. In such embodiments, the energy efficiency of the microfluidic flow rate control device can be improved since it can be configured so that only the minimum control actions are applied to reach the flow setpoint, even when that means higher settling time. In some other embodiments, the values of the differences associated to the flow and the ranges of the control actions may be different and the operation and combination of the valves and/or the pumps may be associated to different ranges of the difference between the measured flow rate and the predefined flow rate.

In some embodiments, the controller instructs both, the pumps and the valves, to simultaneously modify their pumping powers and passageways independently of the difference between the measured flow rate and the predefined flow rate. In such embodiments, the time required for reaching the predefined flow rate is minimized at the cost of less energy efficiency.

The present disclosure describes a microfluidic flow rate control device which allows fluids to be dosed with high precision, in a range of microliters/min and in open and/or closed circuits. This control device, depending on its particular application, can be installed in a fixed equipment or in a portable equipment. In general terms, the device integrates basic elements including: pumps and valves; different types of sensors, such as flowmeters, pressure or temperature sensors, among others; interconnection pipes forming the microfluidic conduit, through which the fluid flows within the control device; as well as the corresponding components and accessories of the control and electronic part, thus allowing the connection, management and monitoring of the elements of the control device.

The user has different possibilities to control the device, either remotely, through a USB connection to a computer, or on-site, through a graphic interface on a touch screen, or analogically through a control panel and regulators. All the elements of the device are developed on a micro scale and integrated in a compact module. It is also remarkable that the system has a very low energy consumption in comparison to other similar systems, due to the use of microfluidic and piezoelectric elements. This device offers a solution to the lack of products on the market with a high precision in the microliter/min scale, being also compact, simple and much more accessible or of lower cost.

BRIEF DESCRIPTION OF THE DRAWINGS

To complete the description and in order to provide for a better understanding of the disclosure, a set of drawings is provided. Said drawings form an integral part of the description and illustrate an embodiment of the disclosure, which should not be interpreted as restricting the scope of the disclosure, but just as an example of how the disclosure can be carried out.

The drawings comprise the following figures.

DETAILED DESCRIPTION OF THE DRAWINGS

Figure 1:
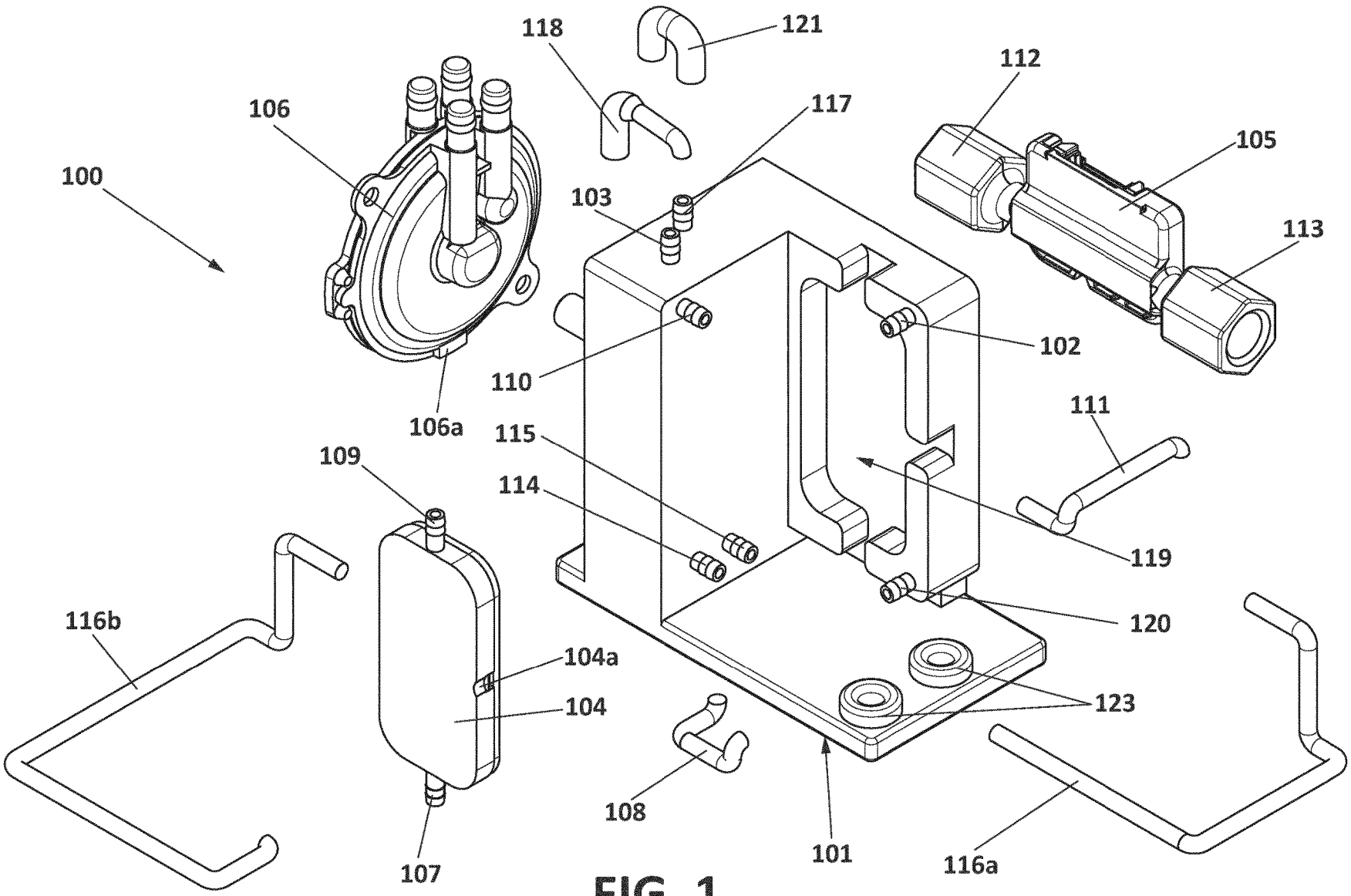
FIG. 1 shows an exploded front perspective view of a microfluidic flow rate control device, according to a particular embodiment of the disclosure.
Figure 2:
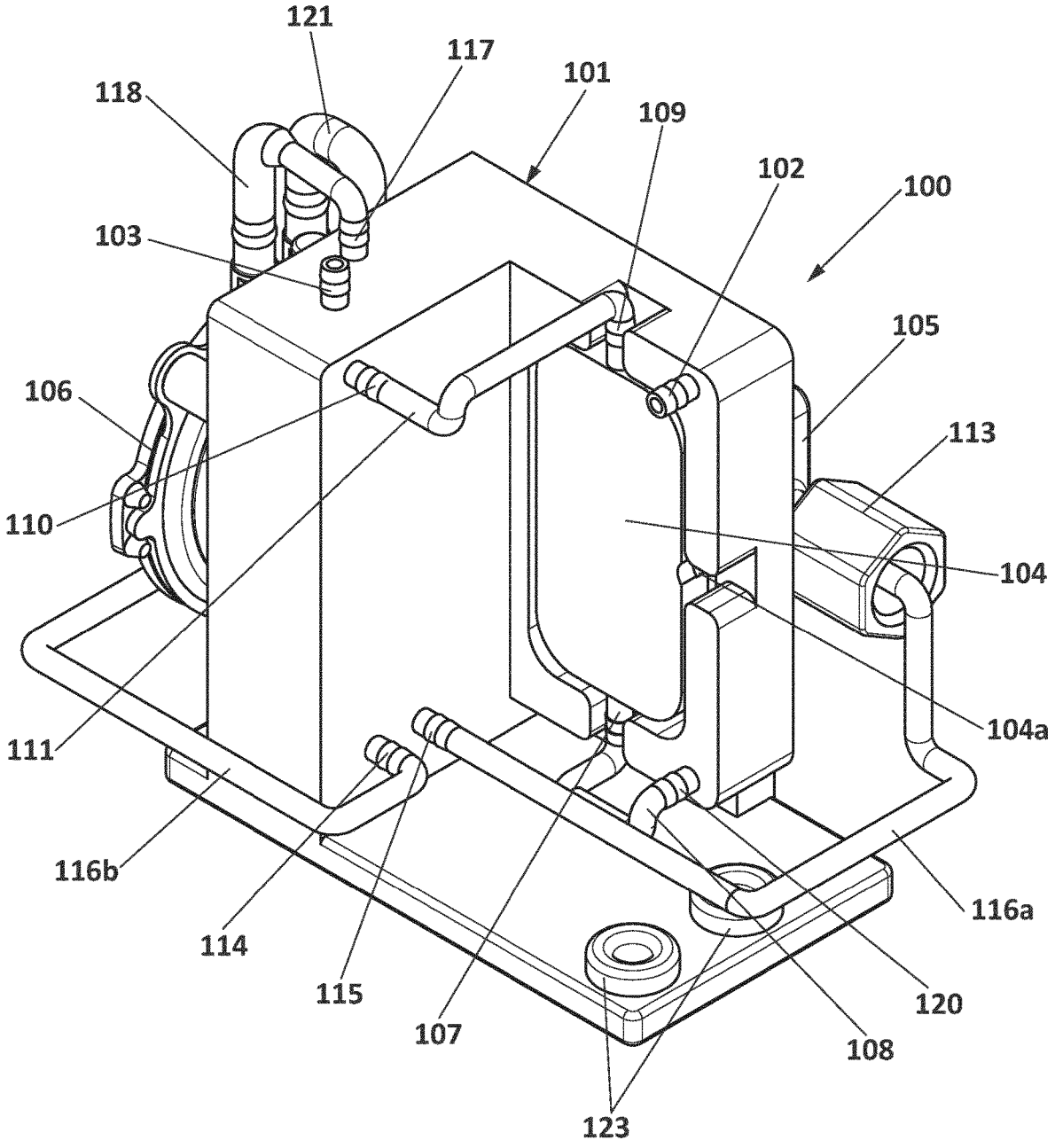
FIG. 2 shows the microfluidic flow rate control device of FIG. 1 with the pump, compressor and flowmeter being removably coupled to the main body.

FIG. 1 shows an exploded front perspective view of a microfluidic flow rate control device 100, according to a particular embodiment of the disclosure. FIG. 2 shows the microfluidic flow rate control device 100 of FIG. 1 with the pump 104, compressor 106 and flowmeter 105 being removably coupled to its main body 101. It should be understood that the control device 100 of FIGS. 1 and 2 may include additional components and that some of the components described herein may be removed and/or modified without departing from a scope of the described control device 100. Additionally, implementation of the control device 100 is not limited to such embodiment.

The microfluidic flow rate control device 100 comprises the main body 101 that partially houses the microfluidic conduit and to which the rest of the components of the microfluidic flow rate control device 100 are removably coupled. The main body 101 has an inlet terminal 102 through which a fluid, e.g., water, enters to the microfluidic conduit and an outlet terminal 103 through which the fluid leaves the microfluidic conduit at the corresponding regulated flow rate.

The microfluidic flow rate control device 100 further comprises a fluid pump 104, partially housed in an recess 119 of the main body 101, to pump the fluid through the microfluidic conduit, a flowmeter 105 to measure the flow rate at that point of the microfluidic conduit, two valves (not shown in this figure) arranged in the microfluidic conduit and located at the outlet terminal 103 and a compressor 106 to actuate the valves. The pump 104 comprises a respective inlet port 107 fluidly connected to the inlet terminal 102 of the microfluidic flow rate control device 100 via an interconnection pipe 108, and an outlet port 109 that is fluidly connected to an intermediate inlet port 110 of the main body 101 via an interconnection pipe 111. The pump 104 further comprises an electrical connector 104*a* to which an electrical wire is communicatively coupled to receive the instructions from the controller to modify the pumping power delivered by the pump 104 to the fluid. In particular, the inlet port 107 of the pump 104 and the interconnection pipe 111 are fluidly connected to the inlet terminal 102 by interposition of the intermediate port 120 and a conduit (not show in this figure) located in the main body 101 that interconnects the inlet terminal 102 to the intermediate port 120.

The flowmeter 105 comprises an inlet port 112 and an outlet port 113 which are fluidly and removably coupled to the respective flowmeter outlet port 114 and flowmeter inlet port 115, respectively, of the main body 101 by interposition of respective interconnection pipes 116*a-b*. In turn, the air compressor 106 is removably and fluidly coupled to a compressor inlet port 117 of the main body 101 by interposition of another interconnection pipe 118. The compressor 106 has four ports, two of them for sucking air and another two for delivering the compressed air. Since in this embodiment only one port of the compressor 106 is to deliver compressed air for actuating the valves, one of the inlet ports and one of the outlet ports of the compressor 106 are interconnected by means of a compressor interconnection pipe 121.

In such embodiment, the microfluidic conduit is formed by the conduits (not shown in this figure) within the main body 101, the conduits (not shown in this figure) within the pump 104, the conduits (not shown in this figure) within the flowmeter 105 and the interconnection pipes 108,111,116*a-b* that removably and fluidly communicate the pump 104 and the flowmeter 105 with the main body 101. The interconnection pipe 118 through which compressed air flows from the compressor 106 to the valves is not part of the microfluidic conduit.

While the microfluidic flow rate control device 100 of FIGS. 1 and 2 depicts one single pump, in some other embodiments there may be more than one pump connected in series to each other. Besides, although the microfluidic flow rate control device 100 of FIGS. 1 and 2 has one single compressor to actuate the two valves that it integrates, there may be more than one compressor that may actuate each one of the valves. In some other solutions, the valves may be piezoelectric valves fed by an electrical connection instead of by compressed air from a compressor. While the microfluidic flow rate control device 100 of FIGS. 1 and 2 shows this particular design, geometry and shape, the microfluidic flow rate control device 100 may have different geometries, designs and shapes depending on the particular uses it may have or the particular systems in which it may be installed.

In some other implementations of the microfluidic flow rate control device 100 of FIGS. 1 and 2, the pump, the valve, the compressor and the flowmeter may be integral parts of the main body or may be non-removable fixed to the main body.

Figure 3:
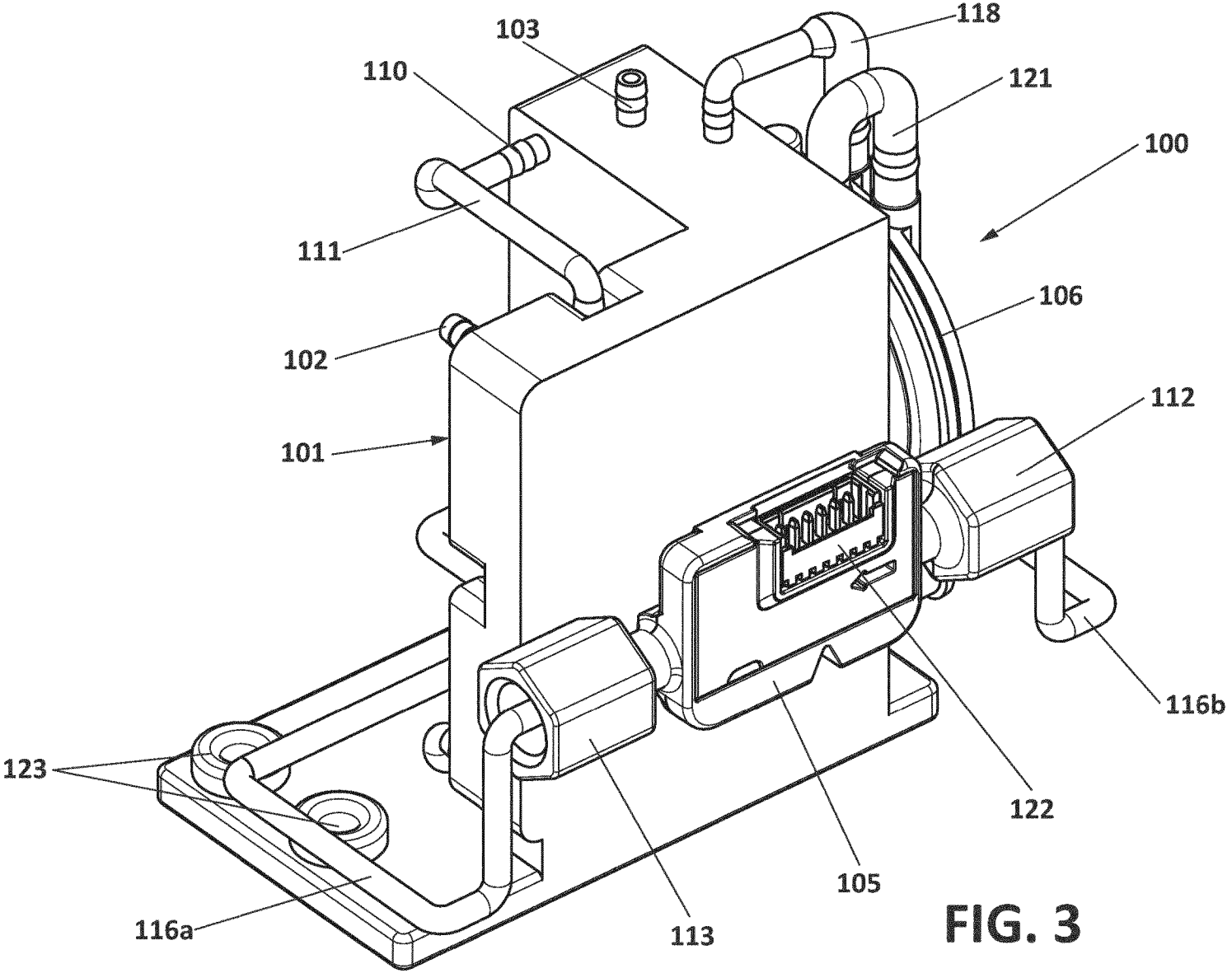
FIG. 3 shows a rear perspective view of the microfluidic flow rate control device of FIG. 1 showing the flowmeter and how it is fluidly connected to the main body.

FIG. 3 shows a rear perspective view of the microfluidic flow rate control device 100 of FIG. 1 showing the flowmeter 105 and how it is fluidly connected to the main body 101. The flowmeter inlet port 112 and the flow meter outlet port 113 are cylindrical ports whose diameter is greater than the diameter of the interconnection pipes 116*a-b*, such that the interconnection pipes 116*a-b* are introduced into said ports 112,113 and fluidly coupled to the flowmeter 105. The flowmeter 105 further comprises a connector 122 to which an electric wire is communicatively coupled to send the values of the measured flow rates to the controller. The measures may be periodically gathered by the flowmeter 105 or may be gathered only when the controller instructs the flowmeter 105 to do so. For example, the flowmeter 105 may measure the flow rate of the fluid flowing inside it every 5 ms. FIG. 3 also shows the passing holes 123 in the support of the main body 101 that are used to fix the microfluidic flow rate control device 100 to a surface or to a component of the equipment it may be mounted on.

Figure 4:
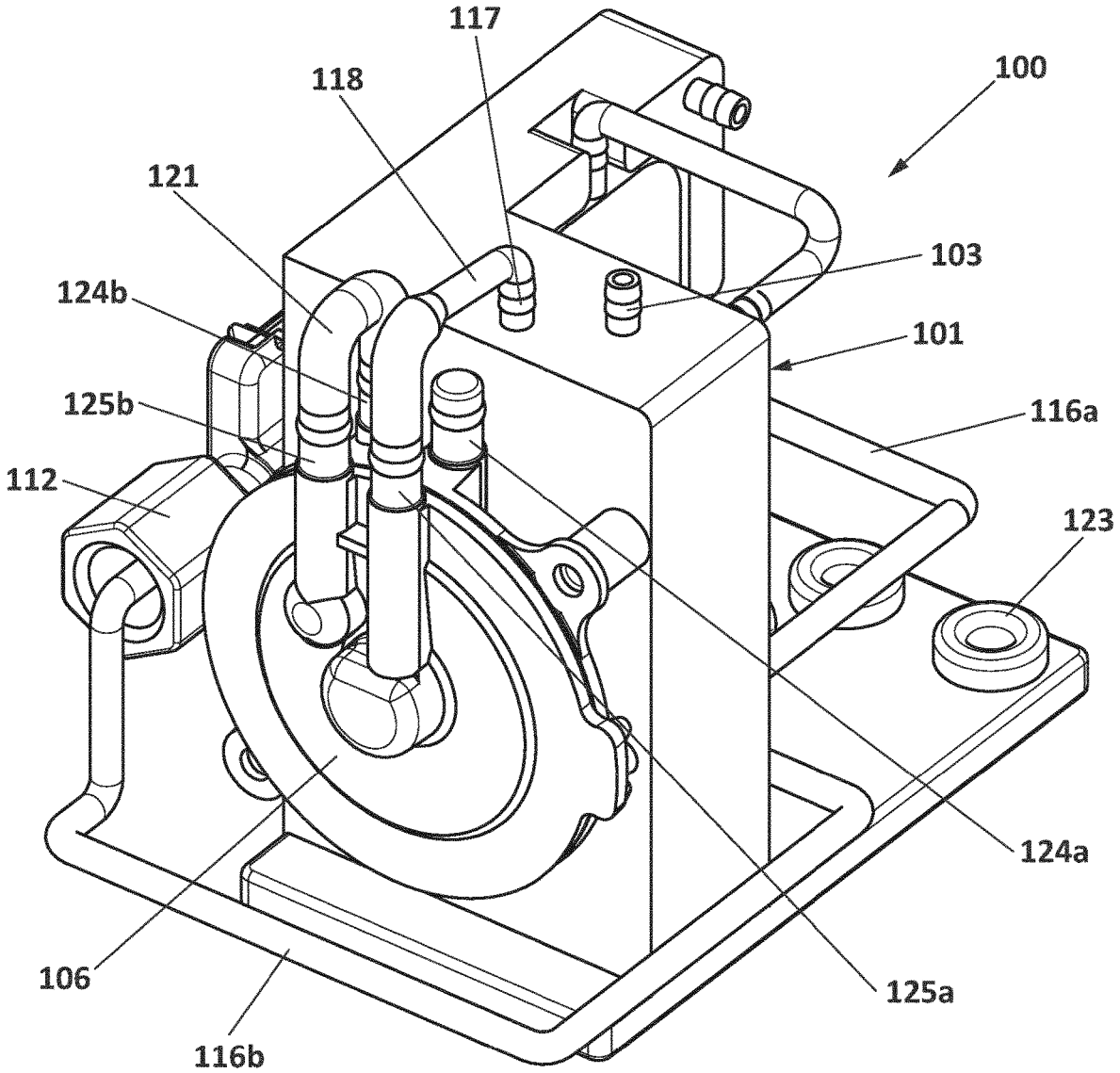
FIG. 4 shows another rear perspective view of the microfluidic flow rate control device of FIG. 1 showing the compressor and how it is fluidly connected to the main body.

FIG. 4 shows another rear perspective view of the microfluidic flow rate control device 100 of FIG. 1 showing the compressor 106 and how it is fluidly connected to the main body 101. The compressor 106 is attached to the main body 101 by means of screws (not shown in this figure). The compressor 106 comprises two air inlet ports 124*a* and 125*b* and two air outlet ports 125*a* y 124*b*. In such embodiment, the air inlet port 125*b* and the air outlet port 124*b* are interconnected by means of the compressor interconnection pipe 121 to keep port 124*a* as the only air inlet port and port 125*a* as the only air outlet port that delivers the compressed air to the valves located inside the main body 101. The compressor 106 also incorporates a connector 106*a* (shown in FIG. 1), located in correspondence with its lower portion, to which an electrical wire is communicatively coupled to receive the instructions from the controller to modify the passageways of the valves in the microfluidic conduit to which it is fluidly connected.

Figure 5B:
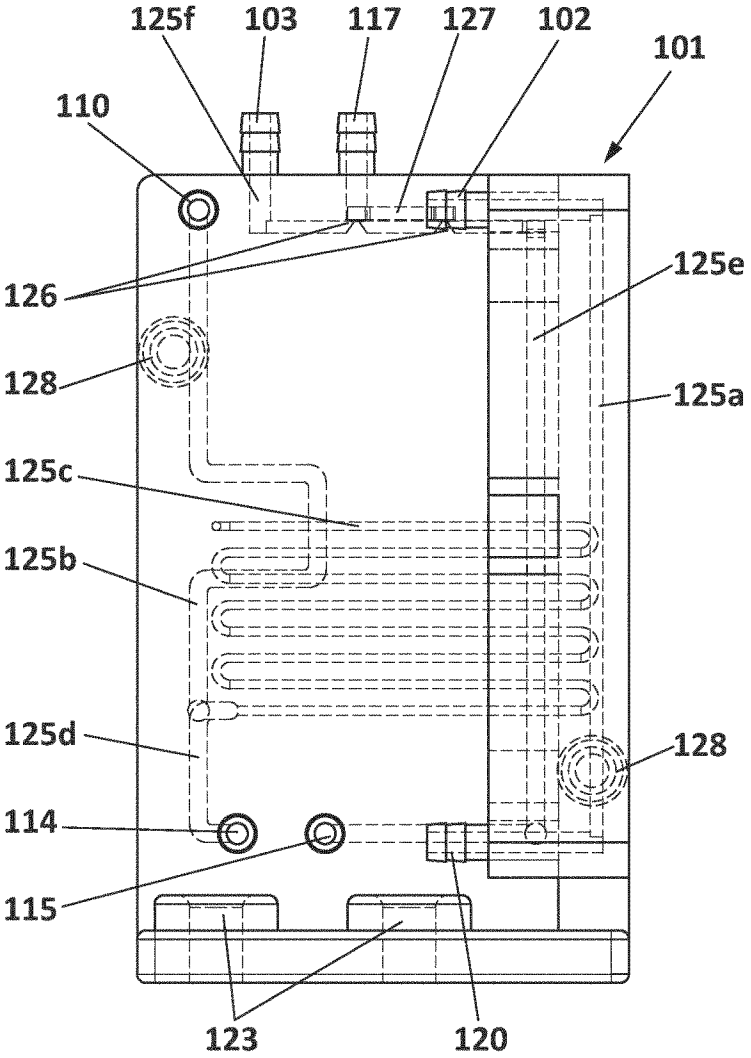
FIGS. 5A and 5B show a front view and a side view, respectively, of the microfluidic flow rate control device of FIG. 1 including part of the microfluidic conduit that is marked with dotted lines.
Figure 5A:
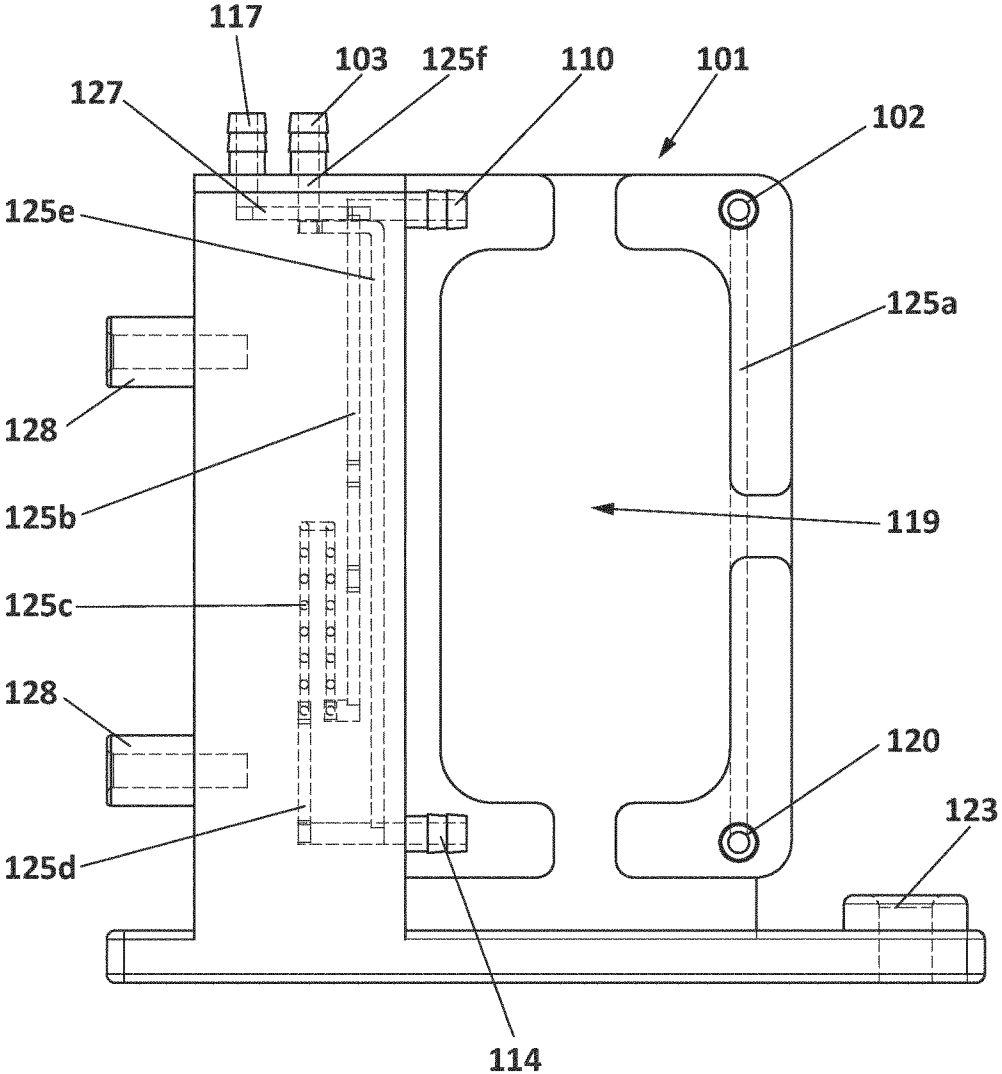

FIGS. 5A and 5B show a front view and a side view, respectively, of the microfluidic flow rate control device 100 of FIG. 1 including the microfluidic conduit 125 that is housed inside the main body 101 and that is marked with dotted lines. The portions of the microfluidic conduit that are housed inside the pump 104, the flowmeter 105 and the interconnection pipes 108, 111 and 116*a-b* are not shown in these figures.

The microfluidic conduit 125 comprises: the inlet terminal 102, a first portion 125*a* corresponding to a first inner duct of the main body 101 connecting the inlet terminal 102 with the first intermediate port 120, a second portion corresponding to the interconnection pipe 108 (not shown in this figure) that fluidly connects the first intermediate port 120 to the inlet port 107 of the pump 104 (not shown in this figure), a third portion corresponding to the inner ducts of the pump 104 (not shown in this figure), a fourth portion corresponding to the interconnection pipe 111 (not shown in this figure) that fluidly connects the outlet port 108 of the pump 104 (not shown in this figure) to a second intermediate port 110, a fifth portion 125*b* corresponding to a second inner duct of the main body 101 that fluidly connects the second intermediate port 110 to the inlet opening of the flow resistance device, in particular, a serpentine circuit 125*c*, a sixth portion 125*d* corresponding to a third inner duct of the main body 101 that fluidly connects the outlet opening of the serpentine circuit 125*c* to the flowmeter outlet port 114, the flowmeter outlet port 114, the flowmeter inlet port 115, the respective interconnection pipes 116*a-b* (not shown in this figure) fluidly connecting the flowmeter outlet port 114 and the flowmeter inlet port 115 to the flowmeter 105 (not shown in this figure), the inner ducts of the flowmeter 105 (not shown in this figure), a seventh portion 125*e* corresponding to a fourth inner duct of the main body 101 that fluidly connects the flowmeter inlet port 115 to two valves 126, the inner ducts of the valves 126, a eighth portion 125*f* corresponding to a fifth inner duct of the main body 101 that fluidly connects the valves 126 to the outlet terminal 103 and the outlet terminal 103. The compressor inlet port 117, the interconnection pipe 118 (not shown in this figure) and the duct 127 fluidly connecting the compressor inlet port 117 to the valves 126 are not part of the microfluidic conduit 125. FIGS. 5A and 5B also shows the support elements 128 on which the compressor 106 is screwed to the main body 101.

While FIGS. 1 to 5 depict a microfluidic flow rate control device 100 having this particular disposition of the microfluidic conduit 125, valves 126, pump 104, flow resistance device 125*c*, flowmeter 105 and compressor 106 in the main body 101, other implementations of the microfluidic flow rate control device 100 may have a different design with different dispositions of the elements forming the microfluidic flow rate control device 100.

Figure 6:
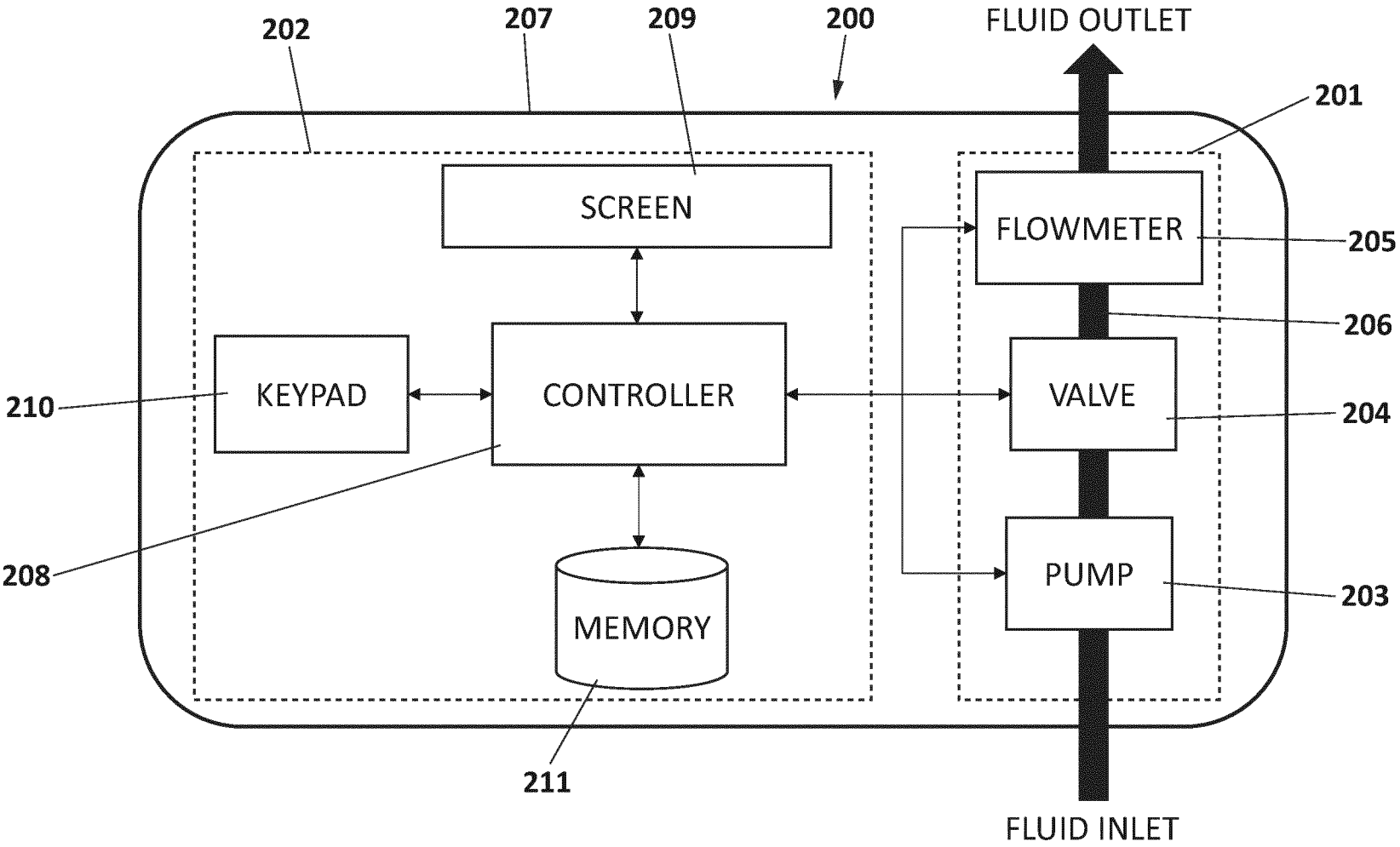
FIG. 6 shows a block diagram of the microfluidic flow rate control device including the electronic subsystem, according to a particular embodiment of the disclosure.

FIG. 6 shows a block diagram of the microfluidic flow rate control device 200 including its hydraulic subsystem 201 and its electronic subsystem 202, according to a particular embodiment of the disclosure. It should be understood that the control device 200 of FIG. 6 may include additional components and that some of the components described herein may be removed and/or modified without departing from a scope of the described control device 200. Additionally, implementation of the control device 200 is not limited to such embodiment.

The hydraulic subsystem 201 comprises all the components of the microfluidic flow rate control device 200 that mechanically impulse, monitor and regulate the flow of fluid that travels through the microfluidic flow rate control device 200. These components are those shown and described in FIGS. 1 to 5. For simplicity reasons only the pump 203, the valve 204 that is arranged in the microfluidic conduit 206 at the outlet of the pump 203 and the flowmeter 205 located at the outlet of the valve 204 are shown. Said hydraulic subsystem 201 and the electronic subsystem 202 are housed within a protective housing 207 that may be made of plastic or metallic material, among other materials, with enough structural rigidity to house and protect all the components of the microfluidic flow rate control device 200.

The electronic subsystem 202 comprises a controller 208, that may be a programmable PLC with its corresponding electronic circuitry, a screen 209, a keypad 210 and a memory 211. The controller 208 may fetch, decode, and execute instructions stored on memory 211 to perform the functionalities of the microfluidic flow rate control device described herein. The memory 211 may be any electronic, magnetic, optical, or other physical storage apparatus to contain or store information such as executable instructions, data, and the like. For example, any memory described herein may be any of Random Access Memory (RAM), volatile memory, non-volatile memory, flash memory, a storage drive (e.g., a hard drive), a solid state drive, any type of storage disc (e.g., a compact disc, a DVD, etc.), and the like, or a combination thereof.

The screen 209 is communicatively coupled with the controller 208 and is configured to display, via a graphical user interface, the parameters measured by the flowmeter or other sensors the control device 200 may integrate. The screen 209 is further configured to display a configuration settings menu of the control device 200. The keypad 210 is also communicatively coupled to the controller 208 and allows a user to select the operating parameters, such as the predefined flow rate value for the fluid flowing through the microfluidic conduit, the initial pumping power of the pumps, and the passageway of the valves, among others, of the microfluidic flow rate control device 200.

Figure 7:
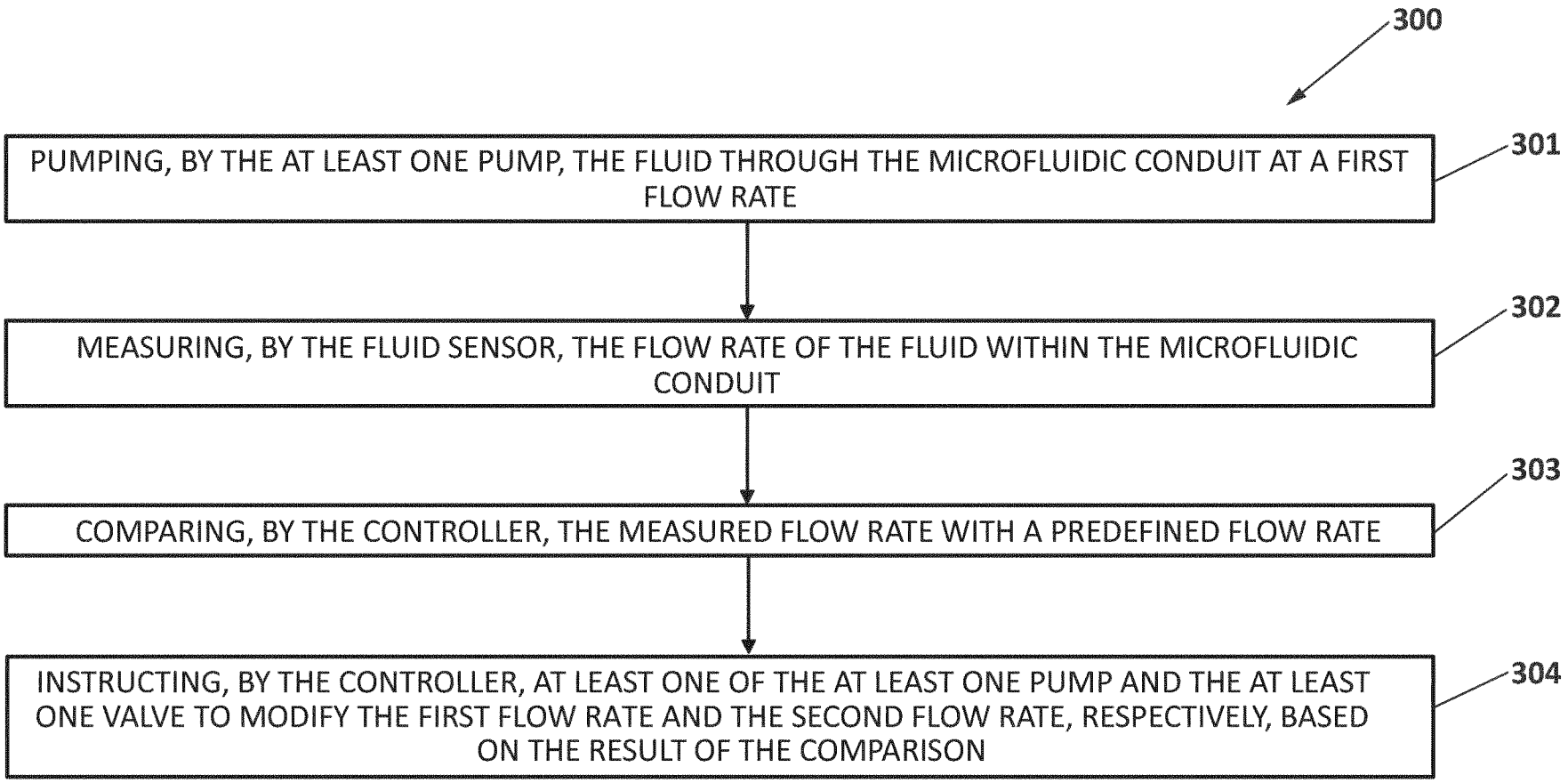
FIG. 7 shows a flow diagram of the method for controlling a flow rate of a fluid flowing through a microfluidic conduit, according to an embodiment of the disclosure.

FIG. 7 shows a flow diagram of the method 300 for controlling a flow rate of a fluid flowing through a microfluidic conduit, according to an embodiment of the disclosure. Although the method 300 of FIG. 7 makes reference to the microfluidic flow rate control device 100 of FIGS. 1 to 5, it may refer to other control devices, such as the control device 200 of FIG. 6, according to the set of claims.

At step 301 of the method 300, the pump 104 of the microfluidic flow rate control device 100 pumps the fluid, e.g., water, entering via the inlet terminal 102 through the microfluidic conduit 125 at a particular flow rate. For example, this particular flow rate may range between 2000 and 500 microlitres per minute.

At step 302 of the method 300, the flowmeter 105 measures the flow rate of the fluid within the microfluidic conduit 125.

At step 303 of the method 300, the controller receives the flow rate measure by the flowmeter 105 and compares it with a predefined flow rate. From said comparison, the controller may determine whether there is a difference between both flow rates that should be corrected.

At step 304 of the method 300, the controller instructs at least one of the at least one pump 104 and the at least one valve 126 to modify their pumping powers and passageways, respectively, based on the result of the comparison, to minimize the difference between the measured flow rate and the predefined flow rate.

Instructing the at least one valve 126 to modify its passageway based on the result of the comparison comprises instructing the corresponding pneumatic pumps or compressors 106 to adjust the passageways of the pneumatic valves 126 based on the result of the comparison.

Preferably, the controller will instruct both, the valves 126 and the pumps 104 to adjust their passageways and pumping powers to adjust the fluid rate of the fluid flowing through the microfluidic conduit so that the predefined flow rate at the outlet terminal 103 of the microfluidic flow rate control device 100 is reached in the shortest period of time.

Figure 8:
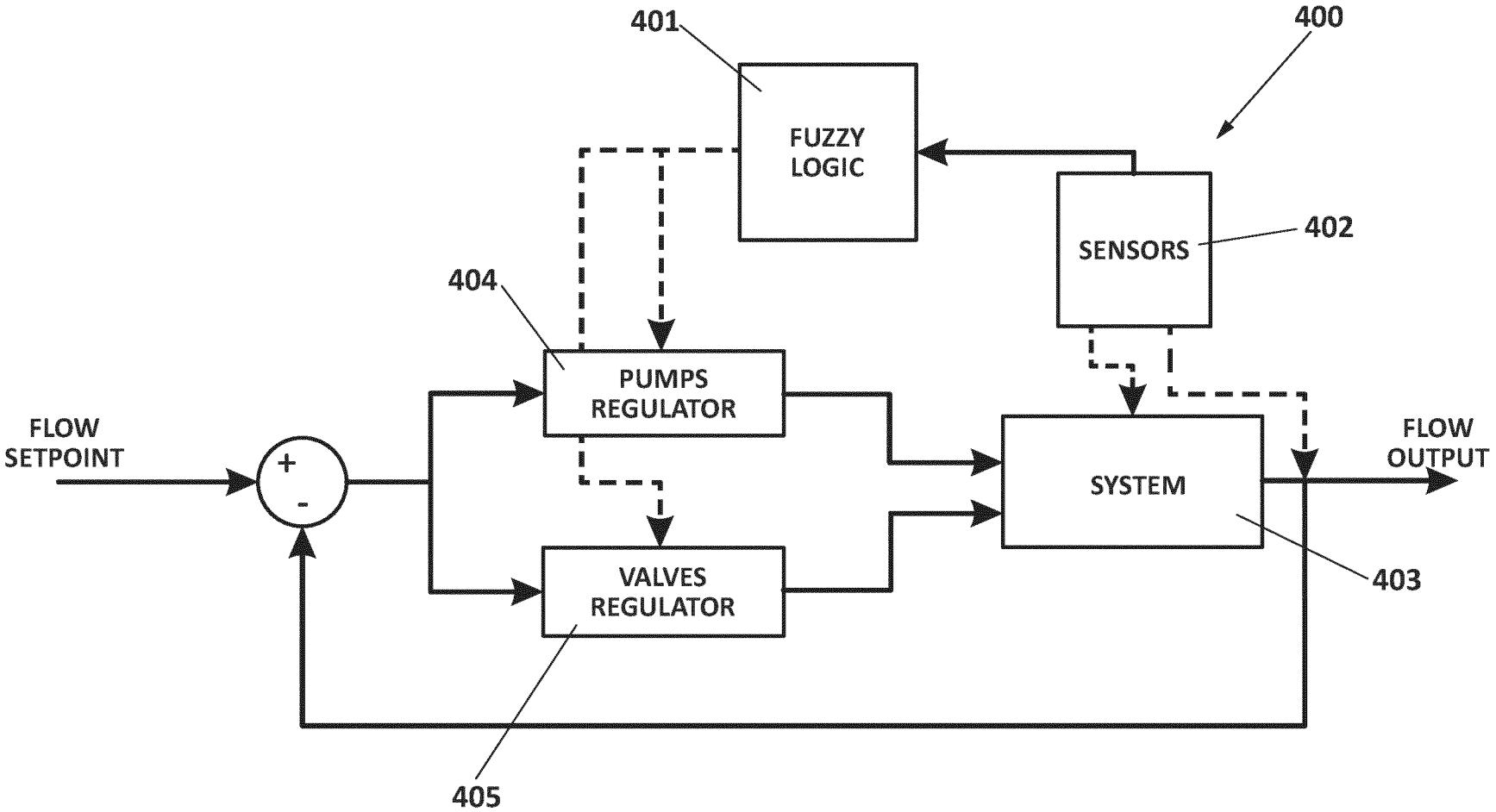
FIG. 8 shows a block diagram of a particular implementation of how the controller may determine instructing the valves and/or the pumps to modify their respective outlet flows based on the results of the comparison.

FIG. 8 shows a block diagram 400 of a particular implementation of how the controller may determine instructing the valves and/or the pumps to modify their passageways and pumping powers, respectively, based on the results of the comparison. The controller may incorporate fuzzy logic to make decisions on whether and to what extent valves and/or pumps will adjust their output flows.

As used herein, fuzzy logic has been described as "many-valued logic" as opposed to "binary logic". Binary logic systems return a single "truth value", or an answer that either matches the variable or does not. Rules including numerical values, for example, tend to be "binary". Fuzzy logic, however, permits multiple matches to the logic and permits more contextually useful information. For example, it can indicate whether a certain operating parameter is "high", "low", or "acceptable"—that is, fuzzy logic can yield an answer that is actually a degree of truth rather than a crisp indication of truth. The fuzzy logic unit 401 of the present disclosure includes input variables, output variables, membership functions defined over the variables' ranges, and fuzzy rules or propositions relating inputs to outputs through the membership functions. The aggregation of all rules is the basis for the fuzzy logic inference process. The rules are applied to the input variables using an inference engine in light of the membership function and results in the output variable.

To do so, the fuzzy logic unit 401 receives the measures from the different sensors 402 the system 403 (the system refers to a global representation of the whole system, including the electrical, electronic and hydraulic elements of the control device) may integrate and together with the flow setpoints known from the functioning of the system 403, execute the pump and valve control actions to instructs the pump regulator drivers 404 and/or the valve regulator drivers 405 whether they should act on the respective pumps and/or valves of the system 403 and to what extent. In other words, the fuzzy logic unit 401 determines how much the pump regulator driver 404 and the valve regulator driver 405 are going to adjust their respective actions in order to minimize the difference between the measured flow rate and the predefined flow rate in the shortest lapse of time. Then, the pump regulator driver 404 and the valve regulator driver 405 will be varying their calculations for the pumping powers and/or passageways values for the pumps and valves, respectively, with the parameters the fuzzy logic has determined them to do until reaching the predefined flow rate at the microfluidic conduit. This fuzzy logic may be also applied to other parameters of the fluid such as the temperature, density, pressure that may be received from the sensors 402.

Therefore, the controller, by means of fuzzy logic, will instruct the pumps to continuously modify or adjust the pumping power they are applying and the valves to simultaneously and continuously modify or adjust their passageways so the difference between the predefined flow rate and the measured flow rate at the flow meter is minimized in the shortest lapse of time.

In this text, the term "comprises" and its derivations (such as "comprising", etc.) should not be understood in an excluding sense, that is, these terms should not be interpreted as excluding the possibility that what is described and defined may include further elements, steps, etc. The term "another," as used herein, is defined as at least a second or more. The term "coupled," as used herein, is defined as connected, whether directly without any intervening elements or indirectly with at least one intervening elements, unless otherwise indicated. Two elements can be coupled mechanically, electrically, or communicatively linked through a communication channel, pathway, network, or system.

The disclosure is obviously not limited to the specific embodiments described herein, but also encompasses any variations that may be considered by any person skilled in the art (for example, as regards the choice of materials, dimensions, components, configuration, etc.), within the general scope of the disclosure as defined in the claims.

The invention claimed is:

1. A microfluidic flow rate control device for controlling a flow rate of a fluid flowing through a microfluidic conduit, characterized in that the control device comprises:

an inlet terminal for fluid input and an outlet terminal for fluid output;

the microfluidic conduit that fluidly connects the inlet terminal with the outlet terminal;

at least one pump arranged in the microfluidic conduit for pumping the fluid through the microfluidic conduit at a flow rate;

at least one proportional valve removably coupled to the microfluidic conduit, the at least one proportional valve being configured to adjust the flow rate of the fluid by proportionally modifying their passageways;

a flow sensor arranged in the microfluidic conduit, the flow sensor being configured to measure the flow rate within the microfluidic conduit; and a controller incorporating fuzzy logic that is configured to receive the flow rate measured by the flow sensor, compare the measured flow rate with a predefined flow rate and instruct at least one of pump regulator drivers of the at least one pump and at least one valve regulator driver of the at least one proportional valve to proportionally modify a pumping power of the pumps and the passageway of the valves, respectively, based on the result of the comparison and the application of the fuzzy logic to a plurality of measurements and a plurality of control variables, so as to minimize the difference between the flow rate measured and the predefined flow rate.

2. The microfluidic flow rate control device according to claim 1, comprising a plurality of proportional valves connected in series to each other along a portion of the microfluidic conduit.

3. The microfluidic flow rate control device according to claim 1, wherein the at least one proportional valve are pneumatic valves and the microfluidic flow rate control device comprises a respective pneumatic pump fluidly connected to each one of the pneumatic valves, the pneumatic pumps being configured to proportionally modify the passageway of the corresponding pneumatic valves based on the result of the comparison.

4. The microfluidic flow rate control device according to claim 1, comprising a plurality of micropumps connected in series for pumping the fluid through the microfluidic conduit.

5. The microfluidic flow rate control device according to claim 1, wherein the at least one proportional valve is arranged in the microfluidic conduit between the flow sensor and the outlet terminal.

6. The microfluidic flow rate control device according to claim 1, comprising a main body at least partially housing the microfluidic conduit and wherein the at least one pump, the flow sensor, the controller and the at least one proportional valve are removably coupled to the main body.

7. The microfluidic flow rate control device according to claim 1, wherein the pumps are piezoelectric micropumps and the at least one proportional valve are piezoelectric valves.

8. The microfluidic flow rate control device according to claim 1, comprising a flow resistance device arranged in the microfluidic conduit that is configured to introduce a constant pressure drop in the fluid flow flowing through the microfluidic conduit.

9. The microfluidic flow rate control device according to claim 1, comprising a pressure sensor arranged in the microfluidic conduit, the pressure sensor being configured to measure a pressure of the fluid flowing through the microfluidic conduit.

10. The microfluidic flow rate control device according to claim 1, comprising a temperature sensor arranged in the microfluidic conduit, the temperature sensor being configured to measure a temperature of the fluid flowing through the microfluidic conduit.

11. The microfluidic flow rate control device according to claim 1, comprising a graphical user interface communicatively coupled to at least one sensor of the microfluidic flow rate control device such that the graphical user interface is configured to display at least one of a flow rate, a pressure and a temperature of the fluid flowing through the microfluidic conduit measured by the at least one sensor.

12. A closed fluid circuit comprising a microfluidic flow rate control device according to claim 1.

13. An open fluid circuit comprising a microfluidic flow rate control device according to claim 1.

14. A method for controlling a flow rate of a fluid flowing through a microfluidic conduit that makes use of the microfluidic flow rate control device according to claim 1, the method including the following steps:

pumping, by the at least one pump, the fluid through the microfluidic conduit at a flow rate, measuring, by the fluid sensor, the flow rate of the fluid within the microfluidic conduit, comparing, by the controller, the measured flow rate with a predefined flow rate, and instructing, by the controller, at least one of the pump regulator drivers of the at least one pump and the at least one valve regulator driver of the at least one proportional valve to proportionally modify a pumping power of the pumps and a passageway of the valves, respectively, based on the result of the comparison and the application of the fuzzy logic to a plurality of measurements and a plurality of control variables, so as to minimize the difference between the flowrate measured and the predefined flow rate.

15. The method according to claim 14, wherein the at least one proportional valve is a pneumatic valve actuated by a pneumatic pump fluidly connected to the at least one proportional valve, and the step of instructing the at least one valve to proportionally modify its passageway based on the result of the comparison comprises instructing the corresponding pneumatic pumps to proportionally adjust the passageway of the pneumatic valves based on the result of the comparison.

16. A microfluidic flow rate control device for controlling a flow rate of a fluid flowing through a microfluidic conduit, characterized in that the control device comprises:

an inlet terminal for fluid input and an outlet terminal for fluid output;

the microfluidic conduit that fluidly connects the inlet terminal with the outlet terminal;

at least one pump arranged in the microfluidic conduit for pumping the fluid through the microfluidic conduit at a flow rate;

at least one proportional valve removably coupled to the microfluidic conduit, the at least one proportional valve being configured to adjust the flow rate of the fluid by proportionally modifying their passageways;

a flow sensor arranged in the microfluidic conduit, the flow sensor being configured to measure the flow rate within the microfluidic conduit; and a controller incorporating fuzzy logic that is configured to receive the flow rate measured by the flow sensor, compare the measured flow rate with a predefined flow rate and instruct the at least one pump regulator driver of the at least one pump and at least one valve regulator driver of the at least one proportional valve to proportionally modify a pumping power of the pumps and the passageway of the valves, respectively, based on the result of the comparison and the application of the fuzzy logic to a plurality of measurements and a plurality of control variables, so as to minimize the difference between the flow rate measured and the predefined flow rate.

17. A method for controlling a flow rate of a fluid flowing through a microfluidic conduit that makes use of the microfluidic flow rate control device according to claim 1, the method including the following steps:

pumping, by the at least one pump, the fluid through the microfluidic conduit at a flow rate, measuring, by the fluid sensor, the flow rate of the fluid within the microfluidic conduit, comparing, by the controller, the measured flow rate with a predefined flow rate, and instructing, by the controller, the pump regulator drivers of the at least one pump and the valve regulator drivers of the at least one proportional valve to proportionally modify a pumping power of the pumps and a passageway of the valves, respectively, based on the result of the comparison and the application of the fuzzy logic to the plurality of measurements and the plurality of control variables, so as to minimize the difference between the flowrate measured and the predefined flow rate.

* * * * *